United States Patent [19]

Baldwin et al.

[11] 3,999,151

[45] Dec. 21, 1976

[54] CROSSGUIDE HYBRID COUPLER AND A COMMUTATING HYBRID USING SAME TO FORM A CHANNEL BRANCHING NETWORK

[75] Inventors: Wiley M. Baldwin, Kingston, N.H.; Hans A. Kvinlaug, Bradford; Han-Chiu Wang, Andover, both of Mass.; William C. Young, Eatontown, N.J.

[73] Assignees: Western Electric Company, Inc.; Bell Telephone Laboratories, Inc., both of New York, N.Y.

[22] Filed: Sept. 8, 1975

[21] Appl. No.: 611,586

[52] U.S. Cl. ..... 333/10; 333/11; 333/98 R

[51] Int. Cl.[2] ..... H01P 5/16; H01P 5/18

[58] Field of Search ..... 333/10, 11, 9, 98 R

[56] References Cited

UNITED STATES PATENTS 3,727,152 4/1973 Bodonyi ..... 333/10

OTHER PUBLICATIONS

Montgomery et al, Principles of Microwave Circuits, Radiation Lab. Series 8, McGraw-Hill, N.Y., 1948, pp. 445–447 relied on.

*Primary Examiner*—Paul L. Gensler
*Attorney, Agent, or Firm*—D. J. Kirk; D. D. Bosben

[57] ABSTRACT

A waveguide hybrid coupler having a pair of intersecting, rectangular, waveguides formed in a planar block of material. The coupling region at the intersection of such waveguides has two pairs of opposed corners wherein at least one pair of opposed corners projects into the coupling region.

Additionally, a commutating hybrid is formed by connecting two such crossguide hybrid couplers with a pair of rectangular waveguide sections of unequal length. The commutating hybrids are then further connected in cascade to form a channel branching network which will combine and/or separate a plurality of frequency channels presented to the network.

11 Claims, 14 Drawing Figures

PRIOR ART

CROSSGUIDE HYBRID COUPLER AND A COMMUTATING HYBRID USING SAME TO FORM A CHANNEL BRANCHING NETWORK

BACKGROUND OF THE INVENTION

1. Field of the Invention

This invention relates to waveguide hybrid couplers and to commutating hybrids and channel branching networks incorporating a plurality of such waveguide hybrid couplers therein. In particular, the waveguide hybrid coupler has a coupling region located at the intersection of two rectangular waveguides.

2. Description of the Prior Art

Various types of waveguide hybrid couplers are known in the prior art. Such couplers have four waveguide ports and have the property that signal power incident at one of the input ports will divide equally between two output ports with only a small fraction of the power escaping through the other port.

One well-known waveguide hybrid coupler is referred to as a magic "T" coupler and is arranged such that one of the four waveguides is perpendicular to the plane of the other three waveguides. Another hybrid coupler, referred to as a branch-line coupler, is described in a book titled "Microwave Filters, Impedance — Matching Networks, and Coupling Structures" by Matthaei, Young and Jones published in 1964 by the McGraw-Hill Book Company at pages 809 et seq. The branch-line coupler is a directional coupler comprised of two parallel, rectangular waveguide sections which are coupled through a number of transverse branch lines. Such a coupler is also described in U.S. Pat. No. 3,727,152 to J. Bodonyi. The branch-line coupler in that patent was fabricated by machining a pair of parallel waveguide paths in a planar block of material and then forming connecting channels or branch lines between the paths to obtain the required coupling.

A particular use for such hybrid couplers has been found in forming a commutating hybrid which is used to separate or combine frequency channels. The commutating hybrid is described in an article titled, "Channeling Filter for Trunk Waveguide Communication at Millimetric Wavelengths" by J. Bodonyi in the Marconi Review, Third Quarter 1973, at pages 160 to 192.

The commutating hybrid is formed by connecting two of the four ports of a first waveguide hybrid coupler to two of the four ports of a second waveguide hybrid coupler with two rectangular waveguide sections of different lengths. A pair of multiplexed channel frequencies presented to one of the unconnected ports of the first hybrid coupler will be separated by the commutating hybrid with one of the channel frequencies appearing at one of the unconnected ports of the second hybrid coupler and the other channel frequency appearing at the other unconnected port of the second hybrid coupler. The commutating hybrid is reversible in that separate frequencies applied to the unconnected ports of the second hybrid coupler will be combined by the commutating hybrid and appear at one of the unconnected ports of the first hybrid coupler. Such commutating hybrids may be connected in a cascade or tree arrangement to form a channel branching network to increase the number of frequency channels that may be combined or separated.

Although the magic "T" hybrid coupler provides the desired power division, it disadvantageously requires substantial space due to its nonplanar configuration and also is difficult and expensive to fabricate. Thus, where low cost and compactness of equipment is a necessity, the magic "T" configuration cannot be used. The branchline hybrid coupler described in the above-referred to Bodonyi patent also requires substantial space, for the dimensions of the branch lines are critical and the number of such lines dictate the size of such a coupler. Additionally, fabrication of such couplers is very expensive due to separate machining steps which are required to individually form the branch lines between the parallel waveguides.

A channel branching network, also described in the above-referred to Bodonyi patent, which incorporates a plurality of commutating hybrids which, in turn, is comprised of a pair of branch-line couplers obviously has the same space and machining problems. Accordingly, the fabrication of such a channel branching network is also time consuming and expensive.

SUMMARY OF THE INVENTION

The instant invention precludes the foregoing problems with a crossguide hybrid coupler comprising first and second rectangular sections of waveguide which intersect, forming two pairs of opposed corners at said intersection with at least one of the pairs of opposed corners projecting into the intersection.

Additionally, a commutating hybrid is formed by connecting first and second crossguide hybrid couplers with two rectangular waveguide paths of unequal lengths.

Furthermore, a plurality of such commutating hybrids are connected in cascade to form a channel branching network.

An advantage of the instant crossguide hybrid coupler structure is that it lends itself to being fully machined with a numerically controlled milling machine. The crossguide hybrid couplers are automatically machined in a planar block of material without the necessity of a tool change to form branch lines or the like.

A further advantage is that all ports of the crossguide hybrid coupler are located in the same plane and the coupler is small in size and of a convenient geometry for interconnecting with sections of waveguide.

Additionally, a channel branching network utilizing a plurality of such crossguide hybrid couplers is not only economical to fabricate but requires a minimum of space due to its planar configuration.

Detailed Description of the Invention

Prior Art

Figure 1:
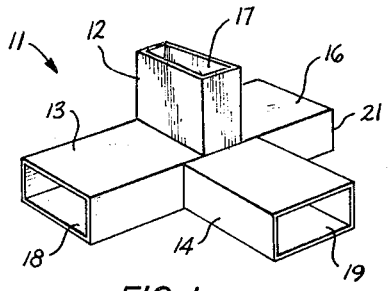
FIG. 1 PRIOR ART
FIG. 1 is an isometric representation of a prior art magic "T" hybrid coupler.
Figure 2:
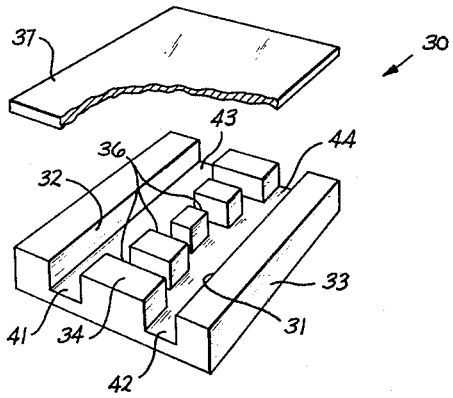
FIG. 2 is an isometric representation of a prior art branch-line coupler.

FIGS. 1 and 2 depict prior art waveguide hybrid couplers. FIG. 1 is well known in the art as a magic "T" hybrid coupler and is generally designated by the numeral 11. The hybrid coupler 11 is comprised of four hollow, rectangular waveguide arms 12, 13, 14 and 16 each having an opening or port 17, 18, 19 and 21, respectively. The arms 13, 14 and 16 are coplanar, while arm 12 is perpendicular to the coplanar arms. When the impedances of the four waveguide arms 12, 13, 14 and 16 are properly matched, signal power entering port 17 will divide equally between the ports 18 and 21 with no output at the port 19. Similarly, energy applied at the port 19 will divide equally between the ports 18 and 21 with no output at the port 17. When an input signal is applied to the port 17, the output at the ports 18 and 21 are in phase opposition, while with the input at the port 19, the outputs at the ports 18 and 21 are in-phase. Accordingly, when equal and in-phase signals are applied to the ports 18 and 21, there will be no output at the port 17 and a full output at the port 19. However, if the equal signal inputs of the ports 18 and 21 are 180° out of phase, there will be no output at the port 19 and full output at the port 17.

FIG. 2 depicts a branch-line coupler, generally indicated by the numeral 30 and having first and second parallel waveguides 31 and 32, respectively, formed in a planar block of material 33. The parallel waveguides 31 and 32 have a common wall 34 therebetween in which there are a plurality of branch lines 36—36 formed. A cover 37 is placed on top of the block 33 forming ports 41, 42, 43 and 44.

The structure of the branch-line coupler 30 of FIG. 2 is shown in the previously referred to Bodonyi patent and the theory of operation of the branch-line coupler is fully described in the aforementioned Matthaei et al. book. Functionally, the magic "T" hybrid 11 of FIG. 1 and the parallel waveguide hybrid 30 of FIG. 2 are similar. For instance, a signal input at port 42 of the coupler 30 can result in outputs at the ports 43 and 44, each having half the input signal power, while there is substantially no output at the port 41.

While both hybrid couplers 11 and 30, shown in FIGS. 1 and 2, respectively, can be advantageously used in particular applications, each has a specific drawback. Due to the three dimensional configuration of the hybrid coupler 11 it is difficult to fabricate resulting in high costs. The branch-line coupler 30 formed in the planar block of material 33 requires more space than the magic "T" hybrid coupler 11 due to critical fixed minimum dimensions of the branch lines 36—36. Additionally, the machining of the branch-line coupler 30 cannot be easily accomplished for once the first and second waveguides 31 and 32 are formed it then becomes necessary to further form the interconnecting branch lines 36—36 in the common wall 34 which are a different size than the waveguides. This necessitates at least one change in the tooling which requires more sophisticated mass production techniques which, in turn, is reflected in higher costs.

CROSSGUIDE HYBRID COUPLER

Figure 3:
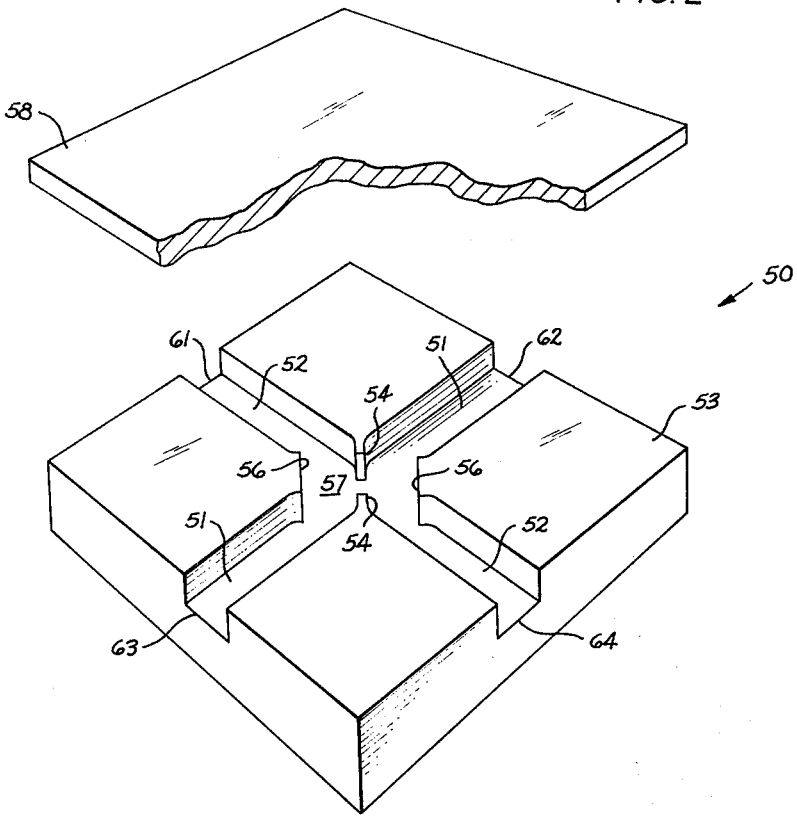
FIG. 3 is an isometric representation of the instant crossguide hybrid coupler.

The crossguide hybrid coupler, generally indicated by the numeral 50 in FIG. 3, solves the foregoing problems. The crossguide hybrid coupler 50 has first and second intersecting waveguides 51 and 52, respectively, formed in a block of material 53. At the intersection of the waveguides 51 and 52 two opposing corners 54—54 project into the intersection while opposing corners 56—56 are machined to form a pair of walls which are parallel to each other and parallel to the projecting corners. This intersection forms a coupling region which is generally designated by the numeral 57. A cover 58 is placed on top of the block 53 and secured by screws (not shown) or brazed in a well-known manner resulting in four openings or ports 61, 62, 63 and 64. The ports 61 through 64 may be further connected to rectangular waveguide connectors (not shown) to fabricate commutating hybrids and channel branching networks which will hereinafter be described.

Ideally, signal power applied to the port 61 will be divided equally between the ports 63 and 64 with no output at the port 62. Electrically, the phase of the signal at the port 64 leads the phase of the signal at the port 63 by 90°. By symmetry, it can be seen that an input signal at the port 62 will be divided equally between the ports 63 and 64, while an input at the ports 63 or 64 will divide equally between the ports 61 and 62.

Although the embodiment of the instant crossguide hybrid coupler 50, shown in FIG. 3, indicates that the waveguides 51 and 52 are mutually perpendicular, it is not so limited. Where the waveguides 51 and 52 do not intersect at right angles the smaller angle of intersection can be any angle less than 90°.

Figure 4:
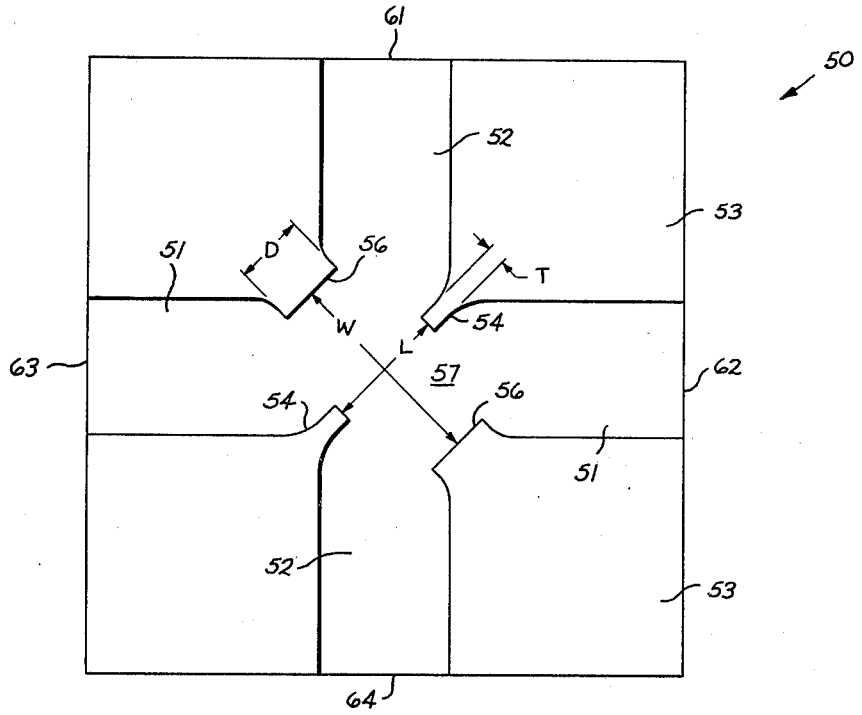
FIG. 4 is a top view (without cover) of the instant crossguide hybrid coupler.

FIG. 4 is a top or plan view of the crossguide hybrid coupler 50 with the cover 58 removed. The coupling region 57 has a distance "L" inches between the projecting corners 54—54 and a distance "W" inches between corners 56—56. The faces or walls of opposed corners 56—56 are "D" inches wide, while the walls of the opposing corners 54—54 are "T" inches in width.

An analysis of the operation of the crossguide hybrid coupler 50 can be made on the basis of even and odd modes. To do this consider the coupling region 57 (see FIG. 3) to be a rectangular section of waveguide "W" wide and "L" long. The dimension "W" should be such a width as to propagate a $TE_{20}$ mode, but not large enough to propagate a $TE_{30}$ mode. An incoming signal at the port 61 excites an even $TE_{10}$ and an odd $TE_{20}$ mode in the coupling region 57. The relative phase and amplitude of the two modes are such that they add to substantially equal the amplitude of the incoming signal at the port 61 and cancel each other at the port 62.

As the two modes travel through the coupling region 57, the phase of the $TE_{10}$ mode advances at a faster rate than that of the $TE_{20}$ mode, since it has a higher phase velocity. If the length "L" is chosen properly, the vector sum of the two modes at the end of the coupling region 57 is such that equal signal power is delivered at the ports 63 and 64.

Figure 5:
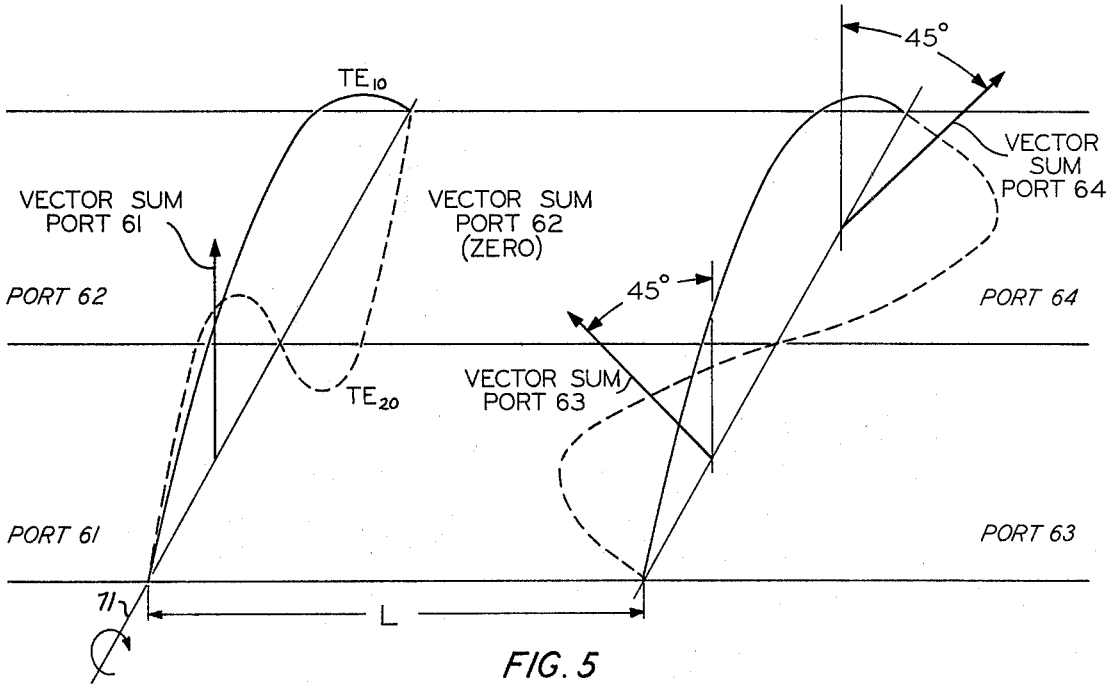
FIG. 5 is a phase-space diagram depicting the operation of the instant crossguide hybrid coupler.

FIG. 5 is a phase-space diagram for the $TE_{10}$ and $TE_{20}$ modes in the coupling region 57. Both modes are represented by rotation about an axis 71, with clockwise rotation indicating an increase in the phase. At the port 61 (input) the $TE_{10}$ and $TE_{20}$ modes are substantially in-phase. Equal power will be delivered to the ports 63 and 64 (outputs) if the $TE_{10}$ mode leads the $TE_{20}$ mode by 90 degrees. It can be deduced that the magnitude of the signal at the port 64 is greater than that of the signal at the port 63 (output) if the $TE_{10}$ mode leads the $TE_{20}$ mode by more than 90°. Accordingly, the magnitude of the signal at the port 64 is less than that of the signal at the port 63 (output) if the $TE_{10}$ mode leads the $TE_{20}$ mode by less than 90°.

The phase of the signal at the port 64 leads the phase of the signal at the port 63 by exactly 90° for a perfect hybrid (i.e., one that is lossless, and has infinite return loss and isolation). For a practical hybrid the phase difference is not necessarily exactly 90°, but may vary slightly depending on the magnitude and phase of both the return loss and isolation. If the return loss and isolation of the hybrid are both 30 db or higher, then the phase deviates from 90° by less than 0.1°.

The foregoing discussion provides a theoretical indication of the workability of a possible practical embodiment of the instant invention. However, the exact dimensions of the structure were determined on an empirical basis by constructing a model such that the dimensions "L," "W" and "D" could be readily varied, while the dimension "T" was held constant (see FIG. 4). Table I lists the effects the different dimensions have on the insertion loss.

TABLE I

| | Insertion Loss | |
|---|---|---|
| Dimension Change | Between Ports 61 and 63 | Between Ports 61 and 64 |
| Increase L | Increase | Decrease |
| Increase W | Decrease | Increase |

Two basic crossguide hybrid coupler designs were fabricated based upon the experimental data obtained from the adjustable models, and the critical dimensional values are shown in Table II. All dimensions are in inches and have a tolerance of ± 0.003 inch.

TABLE II

| Frequency Range (GHz) | L | W | D | T |
|---|---|---|---|---|
| 17.7 – 18.7 | .590 | .856 | .295 | .035 |
| 18.7 – 19.7 | .562 | .792 | .295 | .035 |

The waveguides 51 and 52 were of a standard WR51 size (0.51 inch wide and 0.255 inch deep) and were machined in an aluminum block about one-half inch thick.

The crossguide hybrid couplers 50 so fabricated had a return loss and isolation exceeding 33 db over an appreciable portion of the 17.7 – 18.7 and 18.7 – 19.7 GHz bands and did not go below 30 db. The coupling between ports 61 and 63 and ports 61 and 64 was 3 db ± 0.2 db and was frequency sensitive. This frequency sensitivity can be adjusted by placing capacitive studs in the coupling region 57 as will hereinafter be described.

The structure of the coupling region 57 of the crossguide hybrid coupler 50, as shown in FIGS. 3 and 4, can be advantageously machined automatically on a numerically controlled milling machine. However, other coupling region structures can be fabricated (although not fully machinable) using the instant "crossguide" concept. FIGS. 11A through 11D inclusive depict alternate embodiments of the instant concept. Each of the alternate embodiments were fabricated with aluminum, the waveguide was a standard WR159 size (1.59 inches wide and 0.795 inch deep) and the frequency span was 5.7 to 6.3 GHz.

Figure 6:
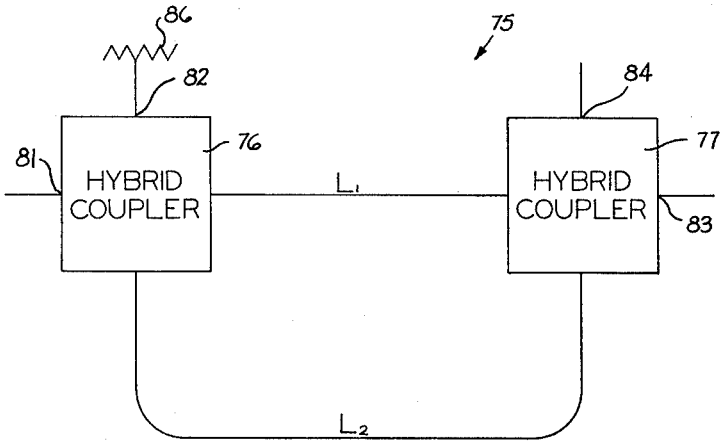
PRIOR ART FIG. 6
FIG. 6 is a schematic diagram of a commutating hybrid.
Figure 11A:
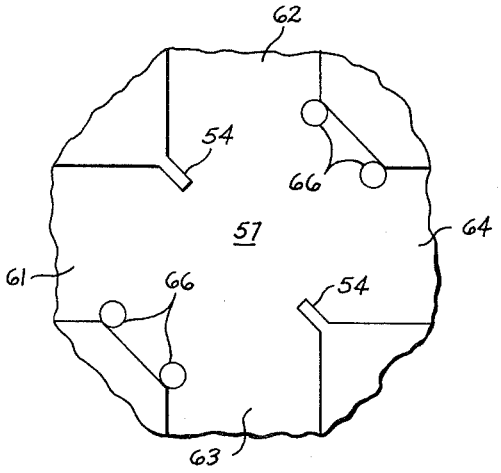
FIGS. 11A through 11D are representations of alternate embodiments of the instant crossguide hybrid coupler.
Figure 11B:
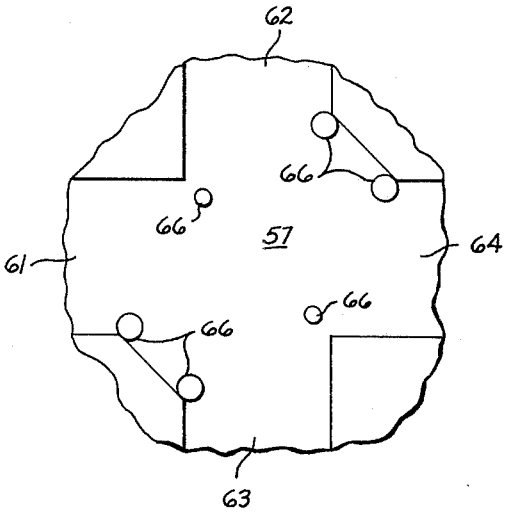

In FIG. 11A the opposing pair of corners 56—56, as shown in FIG. 3, are replaced by a plurality of inductive posts 66—66, while in FIG. 11B the opposing pairs of corners 54—54 and 56—56, as shown in FIG. 6, are replaced by a plurality of inductive posts. The posts 66—66 are in the shape of right circular cylinders each having a diameter about one-tenth the width of the waveguide and extending the full depth of the coupling region 57. The posts 66—66 are made of the same material as the crossguide hybrid coupler 50 (i.e., aluminum) but other conducting materials such as copper, brass or the like can be used. The coupling region arrangement in FIGS. 11A and 11B have good return loss and isolation in the 5.7 to 6.3 GHz band; however, the coupling varied by about 0.7 db over that frequency band. It is anticipated that the coupling variation can be substantially improved in more sophisticated designs.

Figure 11C:
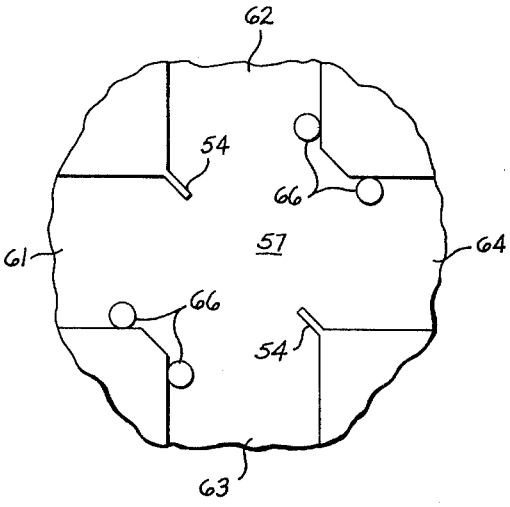
Figure 11D:
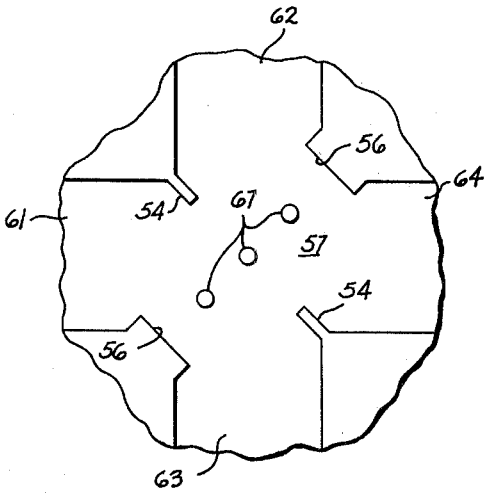

FIG. 11C also has a plurality of inductive posts 66—66 in the coupling region 57, while FIG. 11D has a plurality of capacitive studs 67—67 in the coupling region. The capacitive studs 67—67 also take the general shape of a right circular cylinder and extend a distance of about ten percent of the waveguide height into the coupling region 57 and may be fixedly connected to the bottom of the coupling region 57 or extend downwardly from the cover 58 (see FIG. 3). The studs 67—67 are also made of the same material as the coupler 50 or other conducting materials. The coupling region 57 of FIG. 11C has good flatness in coupling over the frequency range. The arrangement of FIG. 11C was found to have a higher return loss and isolation over a wider frequency range than the coupling arrangement shown in FIG. 11D.

The foregoing description of the crossguide hybrid coupler 50, as shown in FIGS. 3 and 4, is directed to a particular embodiment wherein the intersecting waveguides 51 and 52 are machined in a planar block of material 53. However, the instant invention is not limited to a crossguide hybrid coupler 50 so fabricated. In certain situations it may be desirable to fabricate the instant coupler 50 by joining four rectangular waveguides in a crossguide fashion and forming a coupling region similar to that shown in FIG. 4 or FIGS. 11A to 11D inclusive. Accordingly, the instant invention is directed to a particular coupling region 57 formed at the intersection of waveguide sections and not limited to the manner of construction of such a crossguide hybrid coupler.

COMMUTATING HYBRID

FIG. 6 is a schematic diagram of a commutating hybrid, generally designated by the numeral 75, which is well known in the art and fully described in the above-referred to Marconi Review article. The commutating hybrid 75 is comprised of first and second hybrid couplers 76 and 77, respectively, which are connected by two sections of transmission line of unequal length which are designated $L_1$ and $L_2$. The first hybrid coupler 76 has ports 81 and 82, while hybrid coupler 77 has ports 83 and 84. A power matching load 86 is located at the port 82 to properly terminate that port.

In operation, signal power applied to the port 81 is divided into two equal parts by the first hybrid coupler 76 and transmitted via transmission lines $L_1$ and $L_2$ to the second hybrid coupler 77. The relative phase of the two signals applied to the second hybrid coupler 77 determines the division of signal power between ports 83 and 84. When this phase relation is allowed to vary over the range from zero to 180°, the signal power at port 81 can be divided between output ports 83 and 84 in any desired proportion. For a given line length difference ($L_D$), $L_D = L_2 - L_1$, the phase relationship of the two signals applied to the hybrid coupler 77 is a function of both "$L_D$" and frequency. Input frequencies may be sequentially spaced so that all of the input power associated with predetermined groups of frequencies is delivered to output port 83, while the input power associated with the group of all interleaving frequencies will be delivered to output port 84. In other words, if the input signal is comprised of frequency multiplexed channels having uniformly spaced center frequencies $f_1, f_2, f_3, f_4, f_5, f_6 \ldots$, the length difference $L_D$ can be selected that the frequency channels alternately emerge from the output ports 83 and 84. Accordingly, the channels havig center frequencies $f_1, f_3, f_5 \ldots$ would emerge from output port 83, while the channels having the center frequencies $f_2, f_4, f_6 \ldots$ would emerge from output port 84. Furthermore, the commutating hybrid is reversible in that a plurality of signals applied to ports 83 and 84 will be combined at the port 81.

Figure 7:
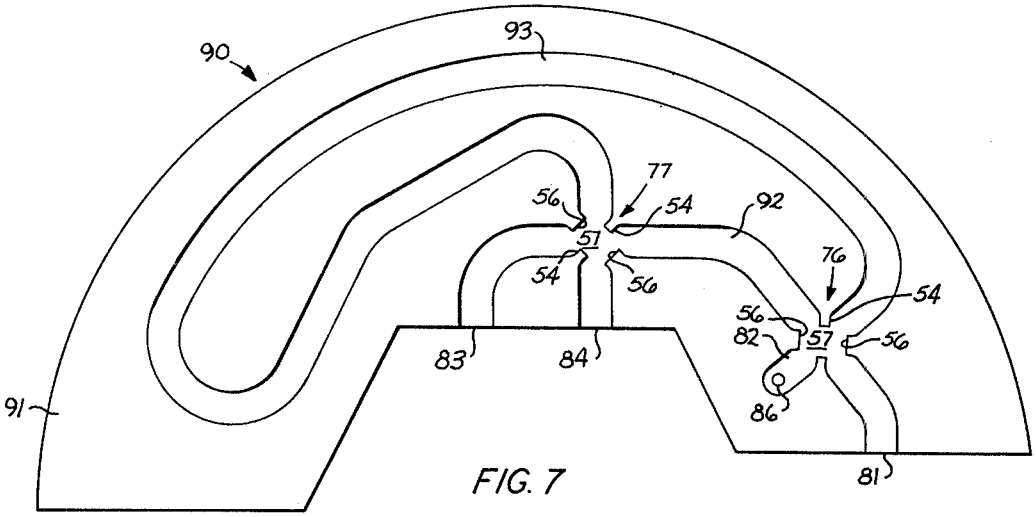
FIG. 7 is a top view (without cover) of a commutating hybrid incorporating a pair of the instant crossguide hybrid couplers therein.

FIG. 7 is an exemplary embodiment of applicants' invention wherein a single commutating hybrid, which is generally designated by the numeral 90, is formed in a substantially semi-circular plate 91 (cover plate removed). Numerals used to generally represent features of the schematic diagram shown in FIG. 6 are used to indicate the same, but more specific structure shown in FIG. 7. Accordingly, in FIG. 7 applicants' commutating hybrid 90 is automatically fully machined from the semi-circular plate 91. The first and second crossguide hybrid couplers 76 and 77, respectively, are connected by a short waveguide path 92 of length $L_1$ and a long waveguide path 93 of length $L_2$. Thus, the commutating hybrid 90 has an input port 81 and a pair of output ports 83 and 84. The power matching load 86 at the port 82 is comprised of a right cylindrical nonconducting core coated with an electrically resistive material, and is mounted in the cover (not shown). The core may be ceramic or other insulating material while the resistance material may be deposited carbon, tantalum or other electrically resistive thin film material. The instant invention is not limited to a particular type of termination for any well-known waveguide termination could be used that meets the electrical requirements of the network. Tapered or stepped waveguide terminations may be used and can be purchased from Emerson and Cuming Inc., Canton, Massachusetts.

As hereinbefore indicated, in relation to the schematic diagram of the basic commutating hybrid 75 described in FIG. 6, the commutating hybrid 90 can be arranged to have a plurality of frequency multiplexed channels having uniformly spaced center frequencies applied to input 81 which will alternately emerge from the output ports 83 and 84. This arrangement is also reversible as previously indicated in relation to FIG. 6.

A specific working model of applicants' commutating hybrid 90 (see FIG. 7) was formed in a block of material 91 using the standard WR51 waveguide size. The long path 93 or "$L_2$" was 23.385 inches in length with a short path 92 or "$L_1$" of 2.11 inches in length (both measurements were made from the center of the coupling region 57 of the first crossguide coupler 76 to the center of the coupling region of the second crossguide coupler 77). The frequency which was dropped or separated from the group of frequencies presented to port 81 was 18.93 GHz.

Figure 8:
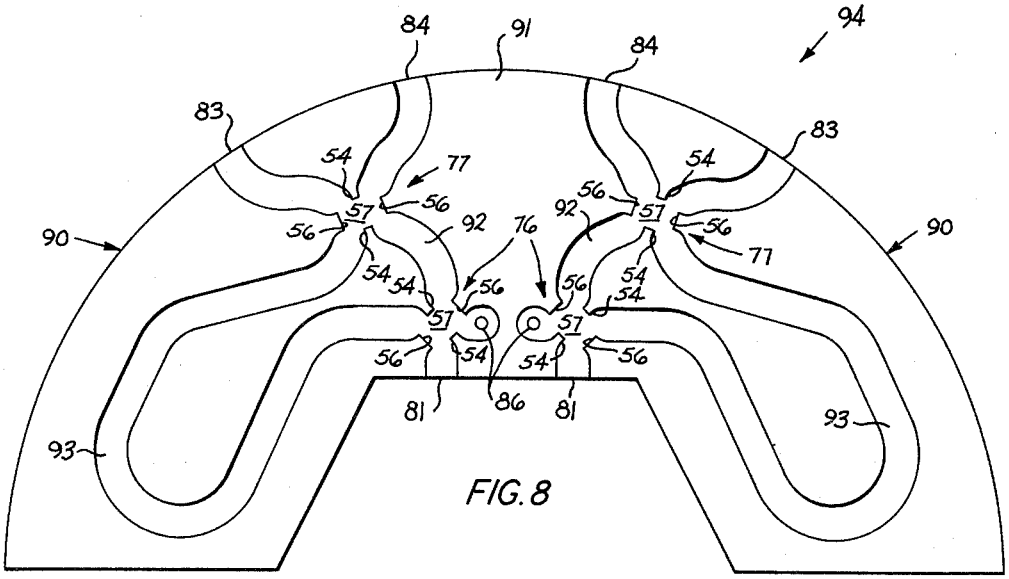
FIG. 8 is a top view (without cover) of a pair of commutating hybrids fabricated in a planar block of material.

FIG. 8 is further exemplary embodiment wherein a pair of commutating hybrids 90—90, generally designated by the numeral 94, are formed in a single block of material 91. Each commutating hybrid 90 operates independently and in substantially the same manner as set forth in relation to FIGS. 6 and 7. The number of commutating hybrids 90—90 that can be formed in a single block of material 91 is limited only by the size of the block of material and the length of the waveguide paths 92 and 93.

CHANNEL BRANCHING NETWORK

Figure 9:
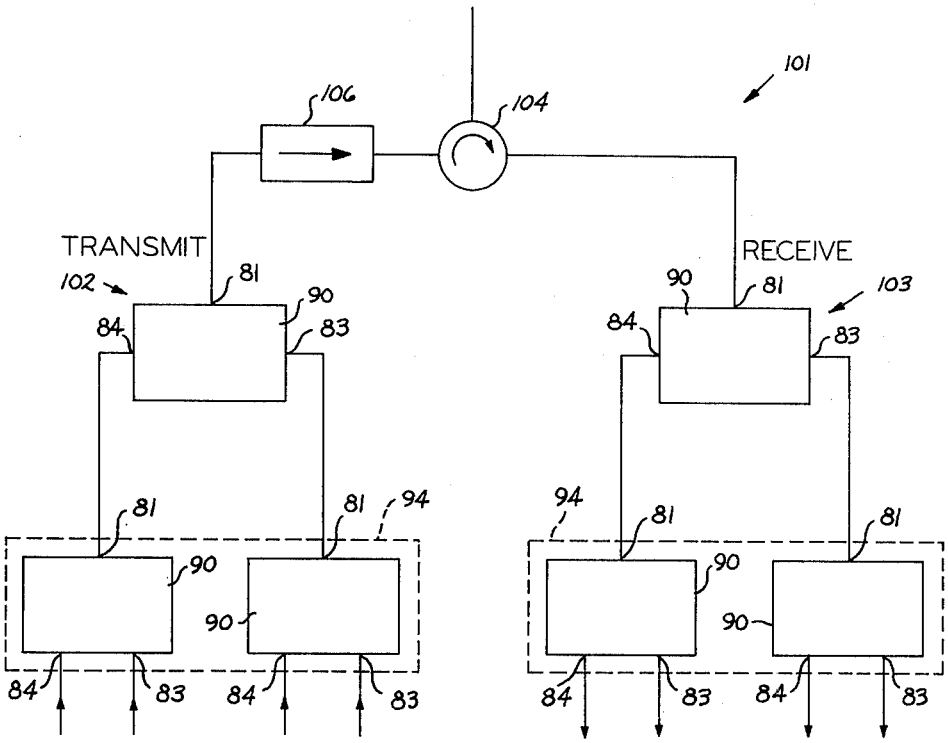
FIG. 9 is a block diagram of a channel branching network.

The single commutating hybrid 90 and a pair of commutating hybrids 94 shown in FIGS. 7 and 8, respectively, may be combined in cascade to form a channel branching network, generally designated by the numeral 101 in the block diagram of FIG. 9. The channel branching network 101 is comprised of a transit and a receive array, generally designated by the numerals 102 and 103, respectively, in combination with a circulator 104 and an isolator 106. The circulator 104 properly routes the received and transmitted signals, while the isolator 106 breaks up reflection paths that exist within the channel branching network 101. The circulator 104 and the isolator 106 may be one of many well known in the prior art and do not form a part of the instant invention. The transmit array 102 combines four transmitter channels, while the receive array 103 separates four receiver channels. It should be clear that additional pairs of commutating hybrids 94 can be further connected in tandem to the arrays 102 and 103 to increase the total number of channels which can be separated and/or combined in the channel branching network 101. It should also be realized that the channel branching network is fully reversible and the transmitting array 102 and the receiving array 103 can reverse their functions by simply reversing the inputs to the arrays.

Figure 10:
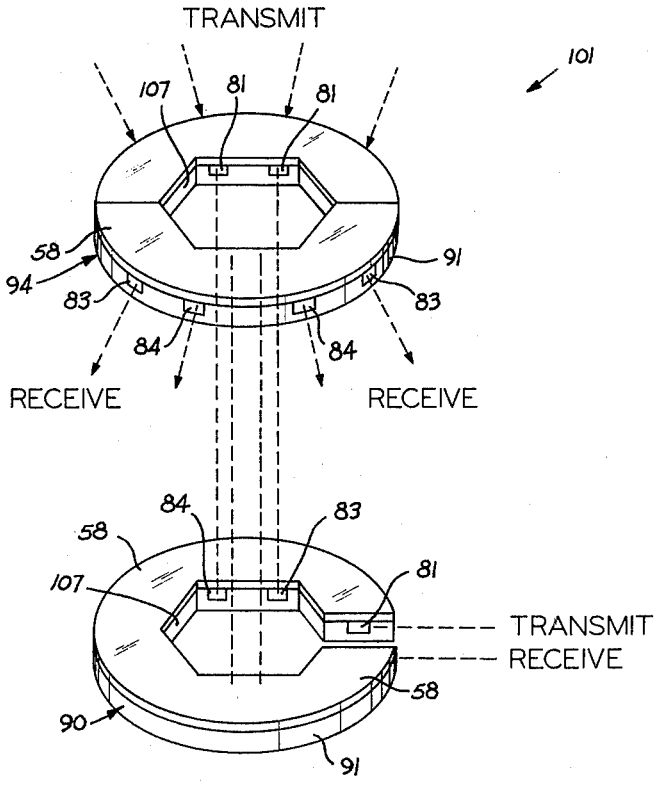
FIG. 10 is an isometric view of a plurality of commutating hybrids arranged in a cylindrical stack and connected to form a channel branching network.

FIG. 10 depicts a particular working embodiment which incorporates the features of the instant invention. In order to increase the compactness of the channel branching network 101, the commutating hybrids 90 and 94 are arranged in pairs, each pair forming a substantially circular planar plate with a central opening 107. The blocks of material 91—91, in which the commutating hybrids 90 and 94 are formed, have covers 58—58 brazed thereon and are then stacked to form a cylinder. As hereinbefore indicated, additional commutating hybrids 90 and/or 94 may be stacked up, increasing the size of the cylinder and providing greater channel capacity. The dashed lines shown in FIG. 10 represent standard waveguide connections.

In a particular application of the instant channel branching network 101 the outer diameter of the circular plate formed by a pair of commutating hybrids 90—90 or 94—94 is shown in FIG. 10, is 15 inches, while central opening 107 has a diameter of 7 inches. Each plate 91 with the cover 58 attached thereto is 1.25 inches thick. The plates 91—91 are aluminum, however, other conducting materials such as brass copper, etc. could be used.

It should be noted that in the instant exemplary embodiment, the crossguide hybrid couplers 76 and 77 are machined in substantially semi-circular plates 91—91 and then stacked to form a cylinder as indicated in FIG. 10. However, the instant invention is not so limited. Machining of the crossguide hybrid couplers 76 and 77 can be accomplished in any geometric planar block of material. The geometry of the plate is normally dictated by the location and space consideration at the installation site. It should be further noted that although the waveguides were machined in the planar block of material 91 it is also contemplated that such plates having waveguides therein could be fabricated by other processes such as casting, electroforming or the like. The block of material 91 could also be an electrically insulative material having the crossguides 51 and 52 formed therein with an electrically conductive material deposited thereon.

What is claimed is:

1. A rectangular waveguide hybrid coupler, which comprises:

first and second rectangular waveguide paths intersecting to form a coupling region having two pairs of opposed corners, at least one of the pairs of opposed corners projecting into the coupling region and the other pair of opposed corners being shaped to form a pair of opposed walls which are substantially parallel to each other and to the pair of projecting corners.

2. A rectangular waveguide hybrid coupler, as set forth in claim 1, wherein the other pair of opposed corners are cut back from the intersection with a plurality of inductive posts positioned at each of said cut back opposed corners.

3. A rectangular waveguide hybrid coupler, as set forth in claim 1, wherein a plurality of capacitive studs are positioned within the coupling region.

4. A rectangular waveguide hybrid coupler, as recited in claim 3, wherein the plurality of capacitive studs are of a height less than the height of the coupling region.

5. A rectangular waveguide hybrid coupler, which comprises:

first and second rectangular waveguide paths intersecting to form a coupling region having two pairs of opposed corners, first inductive posts mounted in the coupling region adjacent respective ones of the corners of one of the pairs of opposed corners, the other pair of opposed corners being shaped to form a pair of opposed walls which are substantially parallel to each other, and second inductive posts mounted adjacent opposite ends of the parallel walls.

6. A rectangular waveguide hybrid coupler comprising:

a first rectangular waveguide formed in a planar block of material; and a second rectangular waveguide formed in the planar block of material and intersecting the first rectangular waveguide to form a coupling region with two pairs of opposed corners at the intersection of the waveguides;

at least one of the pairs of opposed corners projecting into the coupling region and the other pair of opposed corners being shaped to form a pair of opposed walls which are substantially parallel to each other and to the pair of corners which project into the coupling region.

7. A commutating hybrid, which comprises:

a pair of waveguide hybrid couplers connected by rectangular waveguide paths of different lengths, each of said hybrid couplers including first and second waveguide paths intersecting to form a coupling region having two pairs of opposed corners, at least one of the pairs of opposed corners projecting into the coupling region and the other pair of opposed corners being shaped to form a pair of opposed walls which are substantially parallel to each other and to the pair of corners which project into the coupling region.

8. A channel branching network, which comprises:

a plurality of commutating hybrids connected in tandem, each of said commutating hybrids including a pair of waveguide hybrid couplers connectecd by a pair of rectangular waveguide paths of different lengths, each of said waveguide hybrid couplers including first and second rectangular waveguide paths intersecting to form a coupling region having two pairs of opposed corners, at least one of the pairs of opposed corners projecting into the coupling region and the other pair of opposed corners being shaped to form a pair of opposed walls which are substantially parallel to each other and to the pair of corners which project into the coupling region.

9. A channel branching network as set forth in claim 8 wherein:

the commutating hybrids are formed in substantially semi-circular planar plates with each plate having at least one commutating hybrid formed therein.

10. A channel branching network as set forth in claim 9 wherein:

a pair of the semi-circular planar plates are placed adjacent to one another to form a substantially circular plate.

11. A channel branching network as set forth in claim 10 wherein additional pairs of plates are stacked on top of the pair of plates to form a cylinder with the commutating hybrids formed in the stacked plates interconnected by rectangular waveguide sections.

* * * * *